United States Patent [19]

Monser et al.

[11] 4,353,074

[45] Oct. 5, 1982

[54] RADIO FREQUENCY RIDGED WAVEGUIDE ANTENNA

[75] Inventors: George J. Monser, Goleta; Albert A. Roy, Lompoc, both of Calif.

[73] Assignee: Raytheon Company, Lexington, Mass.

[21] Appl. No.: 209,936

[22] Filed: Nov. 24, 1980

[51] Int. Cl.[3] ..... H01Q 13/02

[52] U.S. Cl. ..... 343/786; 343/771

[58] Field of Search ..... 343/772, 778, 786, 776

[56] References Cited

U.S. PATENT DOCUMENTS

| | | | |
|---|---|---|---|
| 3,555,553 | 1/1971 | Boyns | 343/786 |
| 3,698,000 | 10/1972 | Landry et al. | 343/786 |
| 4,063,248 | 12/1977 | Debski et al. | 343/778 |
| 4,124,851 | 11/1978 | Aaron | 343/772 |

*Primary Examiner*—Eli Lieberman

*Attorney, Agent, or Firm*—Richard M. Sharkansky; Joseph D. Pannone

[57] ABSTRACT

A radio frequency antenna comprising a waveguide having opposing relatively wide, upper and lower wall portions, a pair of opposing, relatively narrow side wall portions, and a relatively narrow rear wall portion, such portions being connected to provide a cavity having an open end disposed opposite the rear wall portion, the separation between the side wall portions decreasing as such side wall portions extend towards the rear wall portion. The waveguide includes a ridge disposed within the cavity, the decreasingly separated side wall portions of the waveguide being disposed between the ridge and the rear wall portion of the waveguide. The ridge is coupled to a coaxial transmission line. With such arrangement the decreasingly separated side wall portions of the waveguide improve the impedance matching between the coaxial transmission line and the ridged waveguide antenna element, thereby increasing the operating bandwidth of the ridged waveguide antenna element.

8 Claims, 10 Drawing Figures

FIG. 1
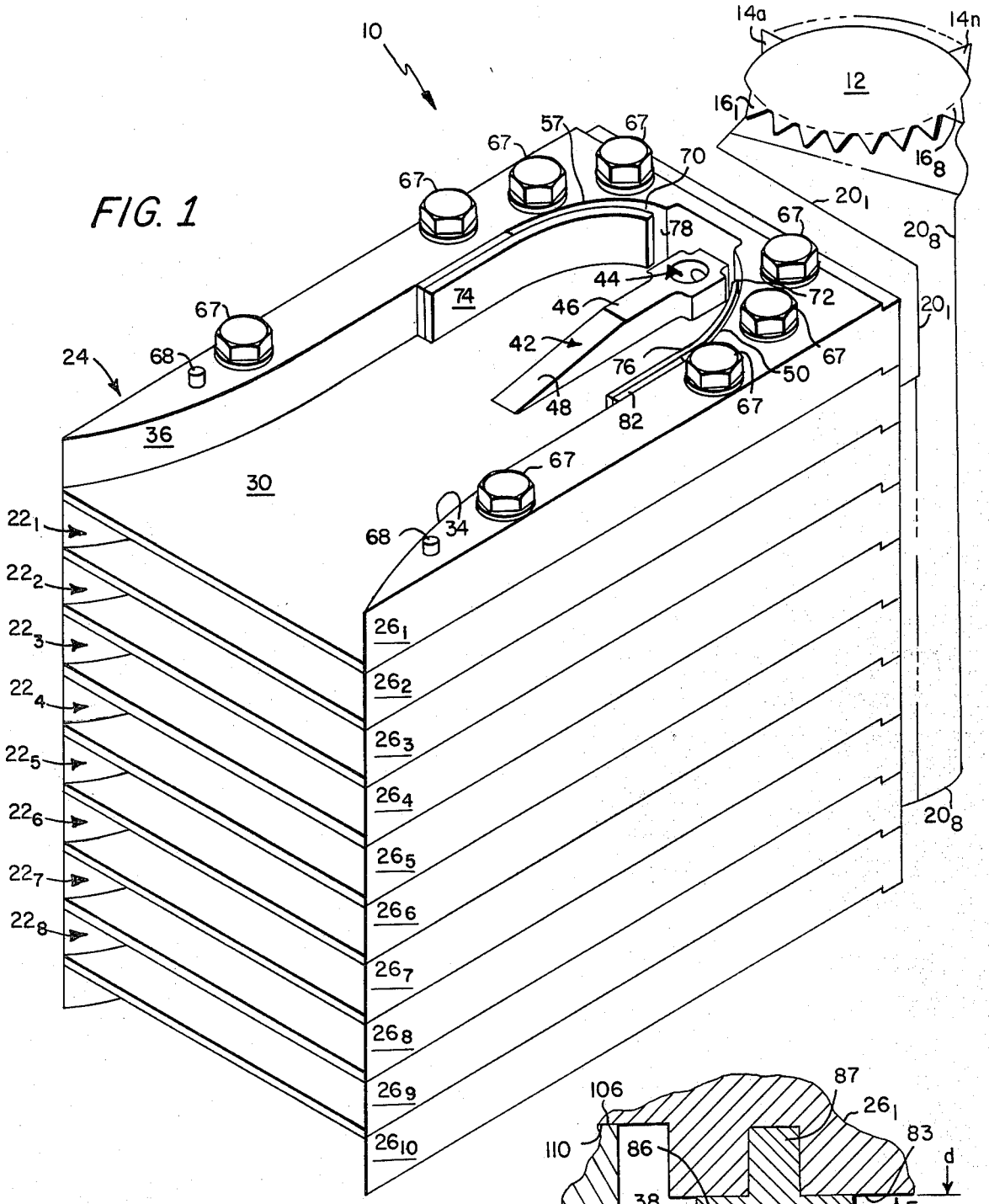
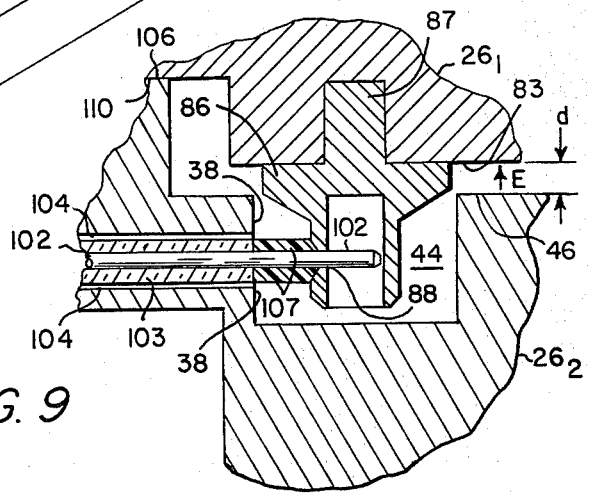
FIG. 9

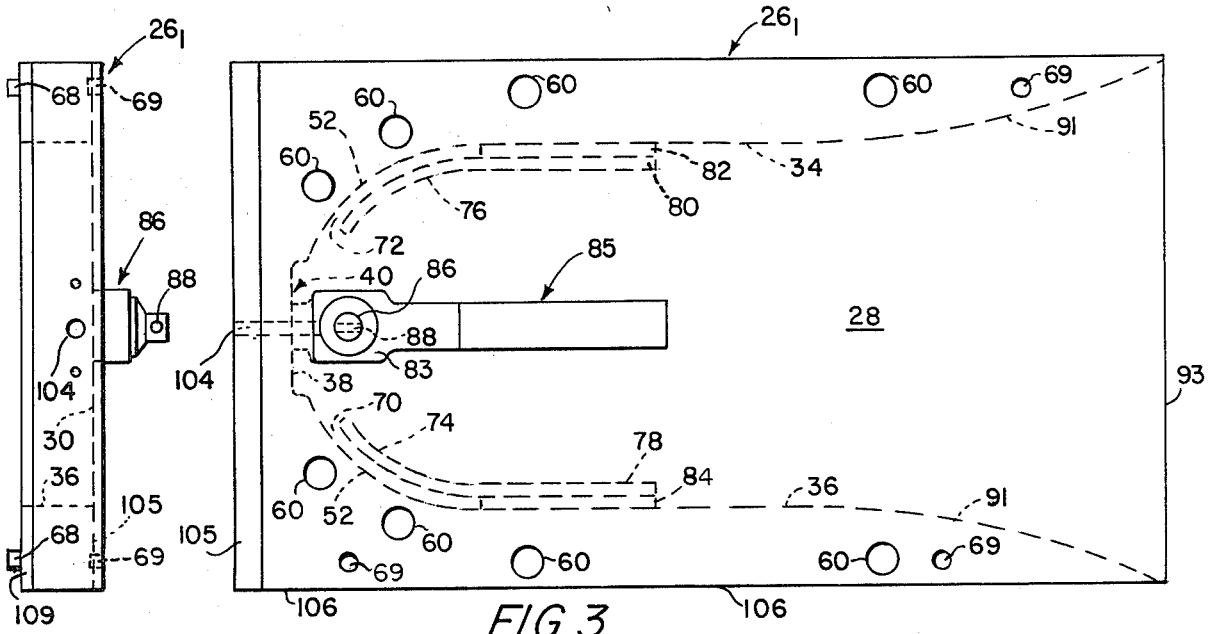
FIG. 4
FIG. 3
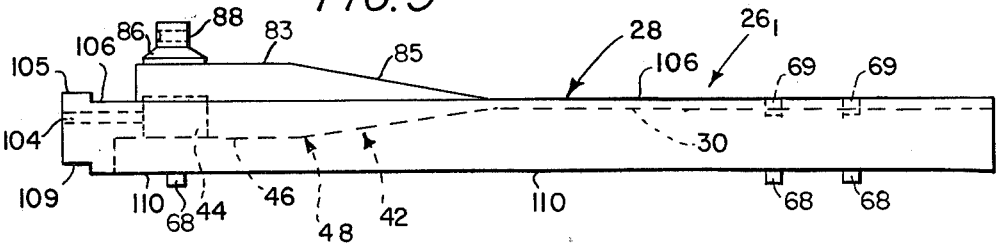
FIG. 5
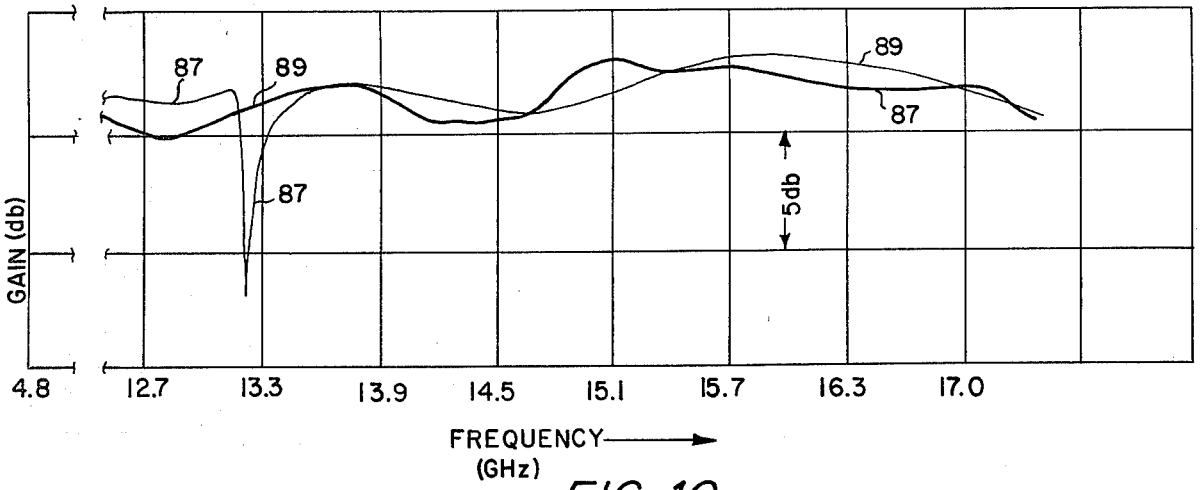
FIG. 10

RADIO FREQUENCY RIDGED WAVEGUIDE ANTENNA

BACKGROUND OF THE INVENTION

This invention relates generally to radio frequency antenna and more particularly to radio frequency antenna adapted to operate over relatively wide frequency bandwidths.

As is known in the art, many installations for array antennas impose physical constraints on the size of such antennas. For example, in an airborne installation each one of the antenna elements in the array thereof should have minimum depth, width and thickness. Further, in many applications it is necessary that the antenna operate over a relatively wide bandwidth and handle relatively high amounts of power during transmission of radio frequency energy. One antenna element which has the appropriate size for airborne installations and which is capable of handling high amounts of power is a double-ridged rectangular waveguide fed by a coaxial transmission line; however, such antenna element is limited in its operating bandwidth.

SUMMARY OF THE INVENTION

In accordance with the present invention, an antenna element is provided, such antenna element comprising a waveguide having opposing relatively wide, upper and lower wall portions, a pair of opposing, relatively narrow side wall portions, and a relatively narrow rear wall portion, such portions being connected to provide a cavity having an open end disposed opposite the rear wall portion, the separation between the side wall portions decreasing as such side wall portions extend towards the rear wall portion. The waveguide includes a ridge disposed within the cavity, the decreasingly separated side wall portions of the waveguide being disposed between the ridge and the rear wall portion of the waveguide. The ridge is coupled to a coaxial transmission line. With such arrangement the decreasingly separated side wall portions of the waveguide improve the impedance matching between the coaxial transmission line and the ridged waveguide antenna element, thereby increasing the operating bandwidth of the ridge of waveguide antenna element.

In a preferred embodiment of the invention, the side wall portions curve in a converging sense to the rear wall portion of the waveguide and the ridge is a tapered ridge. In accordance with another feature of the invention a recess or notch is disposed in the rear wall portion of the waveguide behind the ridge, such recess or notch also improving the impedance match between the coaxial transmission line and the ridged waveguide thereby further improving on the frequency bandwidth of the antenna element.

In accordance with an additional feature of the invention a pair of channels are disposed along the side wall portion of the waveguide such channels being disposed laterally of the tapered ridge. The channels have an open end disposed adjacent the rear wall and a closed end disposed adjacent the distal end of the tapered ridge. Such channels are provided to remove unwanted surface currents established along the side walls which reduce the antenna gain at a particular frequency within the operating band of the element, the length of such channel being $n\lambda/4$ wherein n is an odd integer and $\lambda$ is the wavelength of the unwanted radio frequency energy.

In accordance with still another feature of the antenna the side wall portions of the waveguide disposed between the tapered ridge and the open end of the cavity are flared outwardly along a nonlinear path to increase the surface length of the side wall portions from the tapered ridge to the open end of the cavity within a fixed longitudinal dimension of the antenna element thereby providing a relatively compact antenna element with a side wall length sufficiently long to provide an adequate transition region between the tapered ridge and the open end of the cavity, i.e. between the tapered ridge and free space.

BRIEF DESCRIPTION OF THE DRAWINGS

The foregoing features of this invention, as well as the invention itself, may be more fully understood from the following description read together with the accompanying drawings, in which:

FIG. 1 is a radio frequency antenna system including an array of antenna elements according to the invention;

FIG. 3 is a bottom plan view of the member of FIG. 2;

FIG. 4 is an end elevation view of the member of FIG. 2;

FIG. 5 is a side elevation view of the members of FIG. 2;

FIG. 9 is a cross-sectional view showing a portion of the feed probe and a portion of the pair of members, such FIG. being of region 9—9 of FIG. 8; and FIG. 10 are gain vs. frequency curves of the antenna element of FIG. 7, one curve being associated with an antenna element with channels formed along side walls thereof and the other curve being associated with an antenna element without such channels being disposed along such side wall portions.

DESCRIPTION OF THE PREFERRED EMBODIMENT

Figure 2:
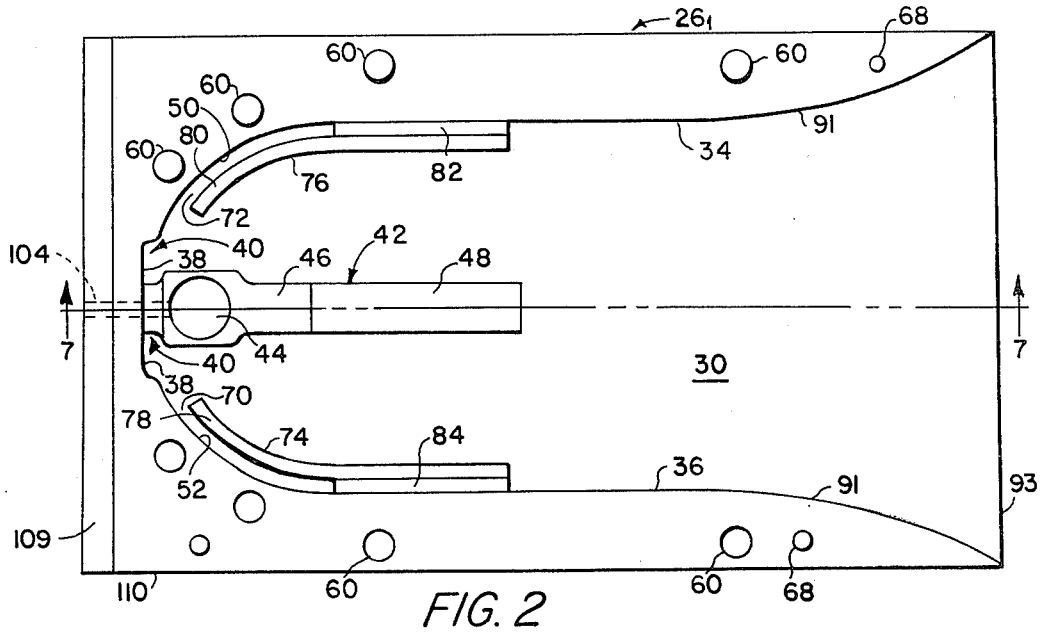
FIG. 2 is a top plan view of a member used to form one of the antenna elements of FIG. 1.

Referring now to FIG. 1 a multibeam radio frequency antenna system 10 adapted to operate over a relatively wide band of frequencies, here from 4.8 GHZ to 18.0 GHZ is shown to include a radio frequency lens 12 having a plurality of feedports 14*a*–14*n* disposed along a portion of the periphery of such lens 12 and a plurality of, here 8, array ports $\mathbf{16}_1$–$\mathbf{16}_8$ disposed along an opposing portion of the periphery of such lens 12, each one of the plurality of array ports $\mathbf{16}_1$–$\mathbf{16}_8$ being coupled to a corresponding one of a like plurality of antenna elements $\mathbf{22}_1$14 $\mathbf{22}_8$, in an array 24, through a corresponding one of a plurality of coaxial transmission lines $\mathbf{20}_1$–$\mathbf{20}_8$, as shown. The shape of the lens 12, the lengths of the transmission lines $\mathbf{20}_1$–$\mathbf{20}_8$ and the arrangement of the antenna elements of $22_1$–$22_8$ are such that n collimated beams of radio frequency energy are formed in free space by the antenna system 10, each one of such n beams having a different direction, as described in U.S. Pat. No. 3,761,936, issued Sept. 25, 1975, "Multi-Beam Array Antenna", Inventors Donald H. Archer, Robert J. Prickett and Curtis P. Hartwig and assigned to the same assignee as the present invention.

Figure 7:
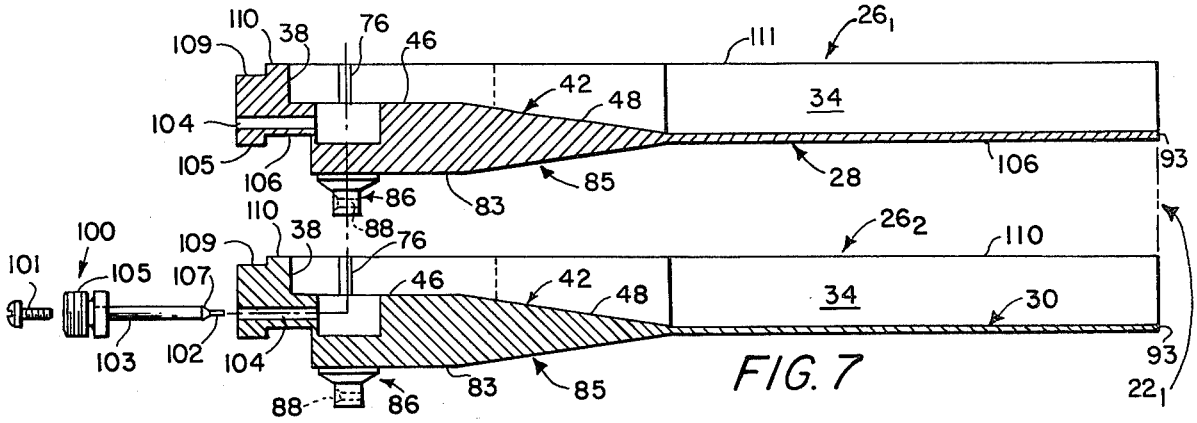
FIG. 7 is an exploded cross-sectional side elevation view of the pair of members of FIG. 6 and a feed probe, such pair of members of FIG. 6 and feed probe forming the antenna element of FIG. 6, such cross-sectional being taken along lines 7—7 of FIG. 2.
Figure 8:
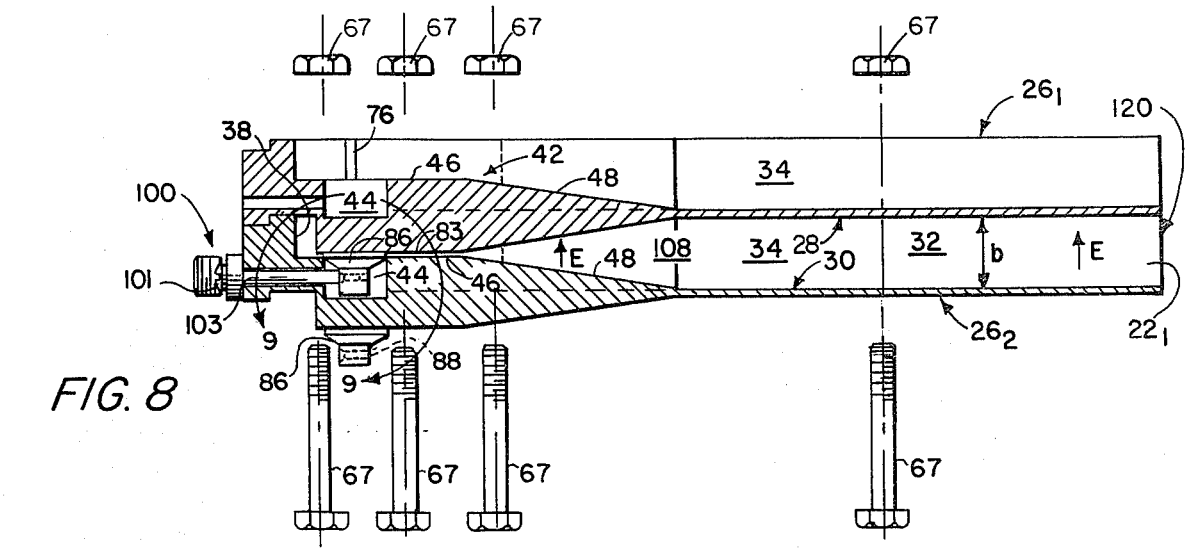
FIG. 8 is a cross-sectional side elevation view of the pair of members of FIG. 7 and feed probe affixed together to form the antenna element of FIG. 7.
Figure 6:
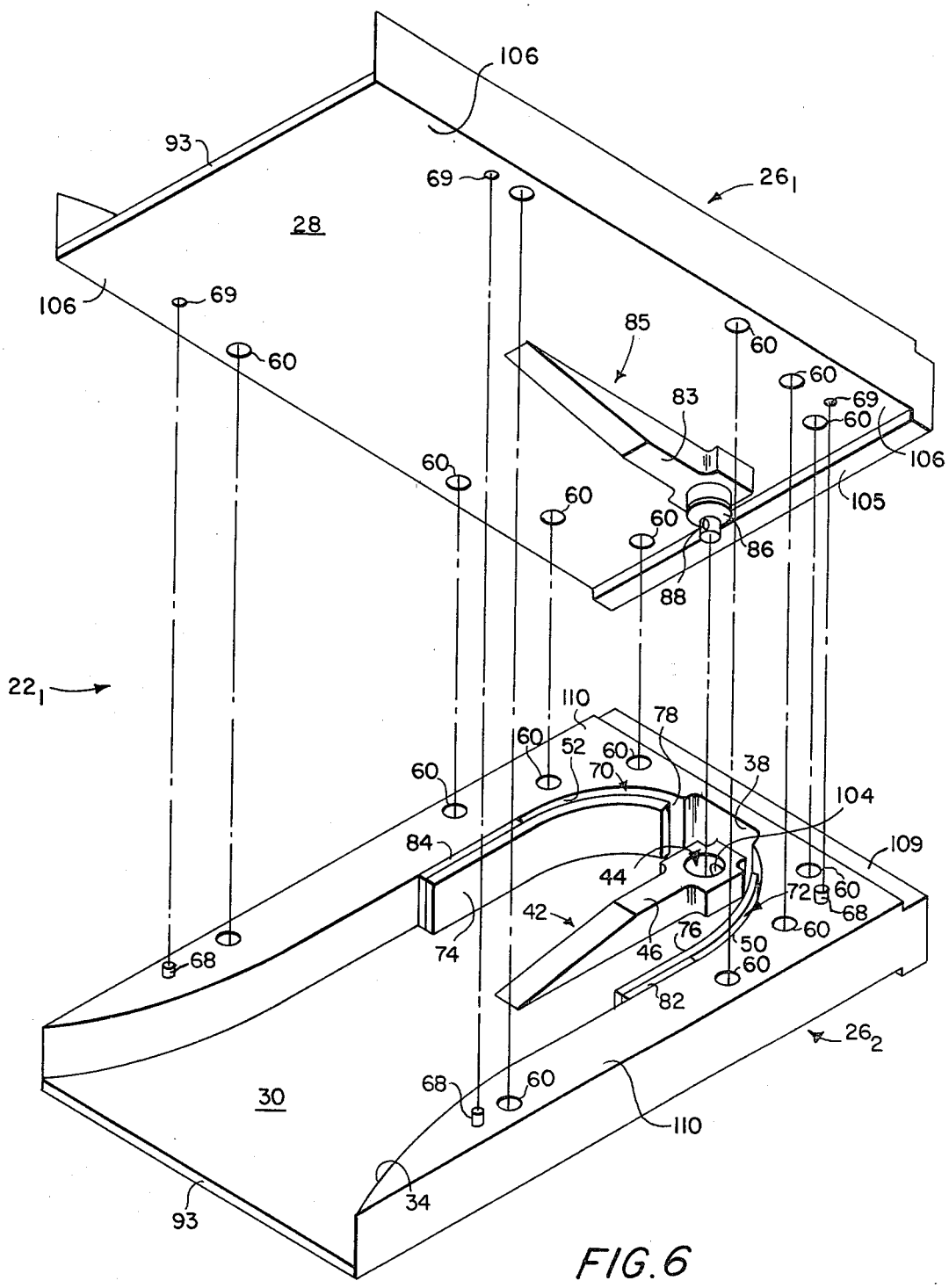
FIG. 6 is an exploded, isometric view of a pair of the members shown in FIGS. 2–5, such pair of members forming, when affixed to each other, one of the antenna elements of FIG. 1.

Array 24 includes a plurality of, here 10, identically constructed conductive members $26_1$–$26_{10}$, an exemplary one of such members $26_1$–$26_{10}$, here member $26_1$ being shown in detail in FIGS. 2–5, a pair of such members $26_1$–$26_{10}$ forming one of the 8 identical constructed antenna elements $22_1$–$22_8$. Thus, an exemplary one of the antenna elements $22_1$–$22_8$, here antenna element $22_1$, include member $26_1$ and $26_2$, as shown in FIGS. 6, 7 and 8. More particularly, as shown in FIGS. 6, 7 and 8, the upper surface of antenna element $22_1$ is formed by the lower surface 28 of member $26_1$ and the lower surface of such antenna element $22_1$ is formed by the upper surface 30 of member $26_2$.

Referring now in more detail to members $26_1$–$26_{10}$, each one of such members $26_1$–$26_{10}$ is constructed from a block of electrically conductive material, here aluminum, here having outer dimensions of 4.037 inches (length) and 2.250 inches (width). The upper surface of such block has machined therein S-shaped side wall portions 34, 36 (FIG. 2) and a rear wall portion 38 have a recess notch or 40 formed therein. The depth of the side wall and rear wall portions is here 0.325 inches. Also machined into the upper surface 30 of the members $26_1$–$26_{10}$ is a tapered ridge 42, as shown, here having a width of 0.20 inches. The tapered ridge 42 has an aperture 44 formed in the upper, flat top portion 46 thereof, the flat top portion 46 terminating in a tapered portion 48, (FIGS. 5, 7) as shown. The length of the tapered portion 48 is here 0.9 inches. The length from the end of the tapered portion 48 to the open end of the waveguide is here 2.2 inches. The depth of the notch 40 formed in the rear wall portion 38 is here 0.075 inches, such notch 40 having a length along the rear wall portion 38 of, here, 0.588 inches. It is noted that the separation between the side wall portions 34, 36 disposed laterally of the tapered portion 48 is relatively constant, here 1.5 inches; however, such separation decreases, here along a curved paths, 50, 52, as such rear wall portions 34, 36 extend towards the rear wall portion 38. As will be discussed in more detail hereinafter, converging the side wall portions 34, 36 as they extend towards the rear wall portion 38 in the region behind the aperture 44 (such aperture being the area where the antenna element $24_1$ formed by such member $26_1$ together with member $26_2$ is fed by the coaxial transmission line $20_1$, (FIG. 1) in a manner to be described) improves the impedance matching between the coaxial transmission line $20_1$, (here a 50 ohm line) and the antenna element $22_1$. Member $26_1$ also has holes 60 drilled through it, such being used for bolting the members together with bolts and nuts 67 as shown in FIG. 1. Holes 69 are formed partly into the upper surface 28 of the member $26_1$ and are used to receive alignment pins 68 (FIGS. 3–5) formed on the upper surface of member $26_2$, as shown also in FIG. 6. Disposed along the curved regions 50, 52 (FIG. 2) of the side wall portions 34, 36 are open ended channels 70, 72. Channels 70, 72 are here formed of curved conductive strips 74, 76, here aluminum having ends 78, 80 spaced from, and affixed to, side walls 34, 36 respectively. The spacing is provided by aluminum spacers 82, 84, such ends 78, 80 and spacers 82, 84 being affixed to the side wall portions 34, 36 through any convenient means as by bolts or a suitable electrically conductive epoxy, not shown. The spacers 82, 84 here have a thickness of 0.1 inches and the length of the channels 70, 72, is here 0.6 inches. The channels 70, 72 are effective in removing unwanted surface currents produced along the side wall portions 34, 36, such currents being associated with radio frequency energy having a frequency of here 13.2 GHZ. That is, referring briefly to FIG. 10, curve 87 shows the gain of the antenna element $26_1$ as a function of frequency without channels 70, 72. It is noted that there is a significant loss of gain at about 13.2 GHZ. Curve 80 shows the gain of the antenna element as a function of frequency with channels 70, 72. It is noticed that the channels 70, 72 have removed the loss of gain in the region of 13.2 GHZ. It is also noted that the length of the channels 70, 72 is here about three quarters of the wavelength of the frequency associated with the unwanted surface currents.

The side wall portion 34, 36 (FIG. 2) disposed between the tapered ridge 42 an the frontal end 93 of the member $26_1$ are flared outwardly along a nonlinear path 91 to increase the surface length of the side wall portions 34, 36 from the tapered ridge 42 to free space within the fixed longitudinal length of the antenna element $26_1$ thereby providing a relatively compact antenna element with a side wall length sufficiently long to provide an adequate transition region between the tapered ridge and free space.

Referring now to the bottom surface 28 of member $26_1$ (shown more clearly in FIGS. 3–6) such surface 28 also has a tapered ridge 85 formed thereon; here, however the flat portion 83 of the ridge 85 has a turret shaped conductive post 86 (here shown) press fit therein by a pin shaped end 87 as shown in FIG. 9. Post 86 has a hole 88 drilled therein as shown for receiving the center conductor 102 of a coaxial connector 100 (FIGS. 7 and 8) in a manner to be described in detail in connection with FIG. 9. It is noted from FIGS. 3 and 5 that the tapered ridges 48, 85 formed on the upper and lower surfaces of member $26_1$ are in alignment or registration with each other. Further, it is evident from FIGS. 2–6 that the post 86 of member $26_1$ fits into the aperture 44 of member $26_2$ as shown in FIGS. 7, 8 and 9.

When members $26_1$, $26_2$ are affixed together, the lower surface 28 of member $26_1$, and the upper surface 30 of member $26_2$ form opposing upper and lower wide surfaces of a hollow rectangular, open ended waveguide structure and side wall portions 34, 36 and rear wall portion 38 form narrow side and rear walls of such open ended, rectangular waveguide More particularly, the affixed members $26_1$, $26_2$ formed a tapered ridge rectangular waveguide antenna element $22_1$. Surfaces 105; 106 of member $26_1$ contact surfaces 109, 110 of member $26_2$ respectively as shown in FIG. 6 so that the flat portions 46, 83 of the ridges 42, 85 are separated a distance d (FIG. 9), and the wide walls of the waveguide, i.e. surfaces 28, 30 are separated a distance b (FIG. 8). The distances b and d are designed so that the waveguide propagates in the $TE_{10}$ mode. Here d is 0.045 inches and b is 0.325 inches. The tapered ridge waveguide antenna elements $22_1$–$22_8$ are fed by the coaxial transmission line $20_1$–$20_8$ through coaxial connectors 100 (FIGS. 7, 8) having a center conductor 102 (FIG. 9) passing through hole 104 (FIGS. 7, 9) and the end of such center conductor 102 press fit to post 86 to provide electrical and mechanical contact to post 86. The outer conductor 105 is electrically and mechanically connected to the member $26_2$ through screws 101 as shown in FIGS. 8 and 9. The inner conductor 102 is separated from the walls of the hole 104 by a dielectric sleeve 103 as shown. A ferrite ring 107 is disposed around the inner conductor 102 between the dielectric 103 and the post 86, as shown in FIG. 9 to provide impedance matching between the coaxial connector 100 and the post 86. Radio frequency energy fed to the antenna element $26_1$ via connector 100 thus launches radio frequency energy into cavity 108 (FIG. 8), such energy travelling towards the open end 120 of the cavity in the $TE_{10}$ mode having an electric field vector extending between the wide surfaces of the waveguide as shown by arrow E in FIGS. 8 and 9.

Having described a preferred embodiment of the invention, it is now evident that other embodiments in cooperating these concepts may be used. It is felt, therefore, that the invention should not be restricted to the disclosed embodiment but rather should be limited only by the spirit and scope of the appended claims.

What is claimed is:

1. A radio frequency antenna element comprising a waveguide having opposing relatively wide, upper and lower wall portions, a pair of opposing relatively narrow side wall portions, and a relatively narrow rear wall portion, such portions being electrically connected to provide a cavity having an open end disposed opposite the rear wall portion, the separation between the side wall portions decreasing as such side wall portions extend towards the rear wall portions;

a ridge disposed within the cavity adjacent the rear wall portion, the decreasingly separated side wall portions being disposed between the ridge and the rear wall portion of the waveguide; and a pair of channels disposed along the side wall portions of the waveguide having an open end and a closed end, such open end being closer to the rear wall portion of the waveguide than the closed end.

2. The antenna element recited in claim 1 including a coaxial transmission line coupled to the ridge.

3. The antenna element recited in claim 1 wherein the separation between the side wall portions increases as such side wall portions extend towards the open end of the cavity.

4. The antenna element recited in claim 1 wherein the rear wall portion has a notch formed thereon.

5. The antenna element recited in claim 3 wherein the rear wall portion has a notch therein disposed behind the ridge.

6. The antenna element recited in claim 1 including a pair of channels disposed along the side wall portions of the waveguide.

7. A radio frequency antenna element comprising:

(a) a waveguide comprising opposing relatively wide, upper and lower wall portions, a pair of relatively narrow side wall portions; and a relatively narrow rear wall portion, such portions being electrically connected to provide a cavity having an open end disposed opposite the rear wall portion, the side wall portions converging as such side wall portions extend from an intermediate region towards the rear wall portion, the side wall portions diverging as such side wall portions extend from the intermediate region towards the open end of the cavity;

(b) a tapered ridge disposed within the cavity proximate the rear wall portion;

(c) a feed connected to the tapered ridge.

8. The antenna element recited in claim 7 wherein the rear wall portion has a notch disposed behind the ridge.

* * * * *